United States Patent [19]

Snead

[11] Patent Number: 5,036,775

[45] Date of Patent: Aug. 6, 1991

[54] COVERED GONDOLA CAR

[76] Inventor: Edwin D. Snead, P.O. Box 529, Georgetown, Tex. 78627

[21] Appl. No.: 444,295

[22] Filed: Dec. 1, 1989

[51] Int. Cl.[5] ..... B61D 39/00

[52] U.S. Cl. ..... 105/377; 105/458; 296/100; 296/220

[58] Field of Search ..... 296/100, 101, 136, 218, 296/220; 105/377, 355, 458

[56] References Cited

U.S. PATENT DOCUMENTS

| | | | |
|---|---|---|---|
| 1,282,417 | 10/1918 | Harvey | 105/377 |
| 2,006,760 | 7/1935 | Franck et al. | 108/5 |
| 2,853,340 | 9/1958 | Hershberger | 296/220 |
| 3,503,341 | 3/1970 | Widell et al. | 105/377 |
| 3,540,771 | 11/1970 | Stoneburner | 105/377 |
| 3,583,334 | 6/1971 | Schuller | 105/377 |
| 3,595,177 | 7/1971 | Bennett | 105/377 |
| 3,831,792 | 8/1974 | Waterman et al. | 105/377 |
| 4,077,329 | 3/1978 | Adler | 105/377 |

FOREIGN PATENT DOCUMENTS

| | | | |
|---|---|---|---|
| 0630085 | 4/1936 | Fed. Rep. of Germany | 105/377 |
| 1109275 | 1/1956 | France | 105/377 |
| 1170331 | 1/1959 | France | 105/377 |
| 2503068 | 10/1982 | France | 105/377 |
| 0598128 | 2/1948 | United Kingdom | 105/377 |
| 0898911 | 6/1962 | United Kingdom | 105/458 |

OTHER PUBLICATIONS

"New X-Panel Roof Provides Greater Strength Under Stress!", dated before 3/16/1970.

*Primary Examiner*—Robert J. Oberleitner
*Assistant Examiner*—Mark T. Le
*Attorney, Agent, or Firm*—Harrison & Egbert

[57] ABSTRACT

A cover for a railroad gondola car comprising a central panel, a first end portion extending downwardly from one side of the central panel, a second end portion extending downwardly from the other side of said central panel, a handle connected to the top surface of said central panel, and a locking mechanism connected to said central panel so as to releasably fix the central panel onto the gondola car. The central panel has an inverted V-shaped configuration. The handle is a longitudinal member positioned in the middle of the central panel and extending laterally across the central panel. A plurality of stiffener members extend across the central panel. The central panel includes an extension section that extends outwardly from the central panel at one end beyond the position of the stiffener members. The locking mechanism includes a tie-down strap positioned adjacent the end portion of each panel and another positioned adjacent the opposite end portion of the last panel.

18 Claims, 2 Drawing Sheets

COVERED GONDOLA CAR

TECHNICAL FIELD

The present invention relates to covers for railway gondola cars. More particularly, the present invention relates to removable covers that extend for the length of a continuous gondola car.

BACKGROUND ART

The transport of garbage presents a continuous problem for railway systems. Gondola cars are appropriate railway vehicles for the transport of such garbage. Unfortunately, the uncovered nature of gondola cars allows such garbage to escape and to be deposited along the railroad tracks.

Since garbage can be of greatly varying size, density, proportion, and volume, removal of the garbage from such gondola cars can be a difficult problem. Present gondola cars require complicated systems for simple unloading procedures. Most of these techniques require expensive facilities that cost millions of dollars. Typical unloading systems turn the cars upside down or allow the material to be dropped through the track onto conveyor systems. If such facilities are not available, then the gondola cars must be unloaded by hand or by some type of machinery. Typically, the machinery will dip out one bucket at a time and place it onto the ground or onto awaiting trucks. This is a fairly slow process which requires a large number of cars to wait while a single machine unloads them one at a time. Alternatively, various unloaders have been developed that cause a tractor-shovel to traverse the top edge of the gondola car so that the hydraulic excavator may dip into the gondola car so as to extract materials. The systems are quite cumbersome and difficult to use. They require specialized equipment and specialized operating procedure. They are not particularly suited for the transport of garbage.

U.S. Pat. application Ser. No. 07/302,380, filed on Jan. 27, 1989, to Edwin deS. Snead, the inventor of the present application, provides a system for the transport of bulk commodities. Specifically, in this application, a continuous gondola car system is disclosed which allows for a continuous runway throughout the plurality of gondola cars. A simple tractor-shovel is placed onto this continuous runway and may be operated so as to easily remove the material from the gondola car. The tractor-shovel will traverse the entire length of the runway so as to empty the gondola car train with a minimum of expense, with a maximum of efficiency, and with a simple procedure.

Various U.S. patents have been issued that provide various systems for the covering of hopper or gondola cars. U.S. Pat. No. 4,239,008, issued on Dec. 16, 1980, to E. B. Conlon, discloses a railway car hatch cover in which a set of hinged covers are adapted to sealably close the rectangular hatch on the roof of a railway hopper car. Each of the covers has a vaulted formation so as to shed water. Suitable latches are provided which allow this cover to lift upwardly about hinges along one side. Unfortunately, such a system is not suitable for use with a continuous gondola car. Since the hinged covers are permanently mounted over the hopper car, there would not be room for the complete operation of the tractor-shovel within the continuous runway. Additionally, the hinging of a cover to the exterior edges of a gondola car would cause the cover to rotate, possibly, into the path of adjoining railway tracks.

U.S. Pat. No. 3,831,792, issued on Aug. 27, 1974, to Waterman et al., discloses an open top gondola car having a plurality of hinged covers that are arranged adjacent to each other. During the loading and unloading of the car, the hinged covers traverse a pathway that automatically causes the covers to lift upwardly. Once again, this apparatus hinges the cover about one side of the gondola car.

U.S. Pat. No. 3,736,883, issued on June 5, 1973, to Yang et al., shows a railway hopper oar roof structure that includes roof hatch covers that are pivotally attached to the central portion of the roof. Suitable linkage is provided to permit upward and inward rotation of the hatch covers when a lifting force is applied to one of the covers. In the top position, the covers form an inverted V on top of the hopper car so as to aid in the direct loading through these hatches.

It is an object of the present invention to provide a gondola car cover that effectively closes the interior of the gondola car.

It is another object of the present invention to provide a cover for a gondola car that can be removed without interfering with adjoining track. It is another object of the present invention to provide a cover for a gondola car that is particularly adaptable for us on continuous gondola car configurations. It is still a further object of the present invention to provide a cover for a gondola car that facilities in the loading, unloading, and transport of garbage within the gondola car. These and other objects and advantages of the present invention will become apparent from a reading of the attached specification and appended claims.

SUMMARY OF THE INVENTION

The present invention is a cover for a railroad gondola car that comprises a central panel, a first end portion that extends downwardly from one side of the central panel, a second end portion &hat extends downwardly from the other side of the central panel, and a handle that is connected to the central panel and extends upwardly therefrom. A suitable locking mechanism is connected to the central panel so as to cause the releasable fixing of the central panel onto the gondola oar.

The central panel has an inverted V-shaped configuration. The central panel is typically comprised of a fiberglass material. The central panel covers, at least a portion of the interior of the gondola car when in its fixed position on the gondola car. The handle is a longitudinal member that is positioned in the middle of the central panel so as to allow for the balanced lifting of this panel. The handle extends laterally across the panel. A plurality of stiffener members extend across the central panel so as to provide strength to the panel. The central panel includes an extension section that extends outwardly beyond the stiffener members. The extension section is suitable for overlapping a portion of an adjacent cover. The locking mechanism includes a first socket that is positioned on one side of the central panel and a second socket that is positioned on the other side of the central panel. These first and second sockets are suitable for receiving a tie-down strap that may be releasably connected to the gondola car.

The present invention is also an improved method for unloading a commodity from a gondola car. This method comprises the steps of: (1) placing a tractor-shovel on the floor of a continuous gondola car; (2) lifting one of the covers from the gondola car; (3) transporting one of the covers such that the cover is positioned on the gondola car aft the tractor-shovel; (4) shovelling the commodity from the interior of the gondola car; and (5) dumping the commodity to the exterior of the gondola car. Within this method, the step of lifting comprises the steps of: (1) moving the shovel of the tractor-shovel in close proximity to the handle of the cover; (2) engaging the handle with a hook that is connected to the shovel; and (3) moving the shovel such that the cover disengages from the gondola car. This method may also include the steps of unlatching the cover from the gondola car prior to the step of lifting. This method would further include the step of latching the cover to the gondola car after the cover is transported aft of the shovel.

DETAILED DESCRIPTION OF THE INVENTION

Figure 1:
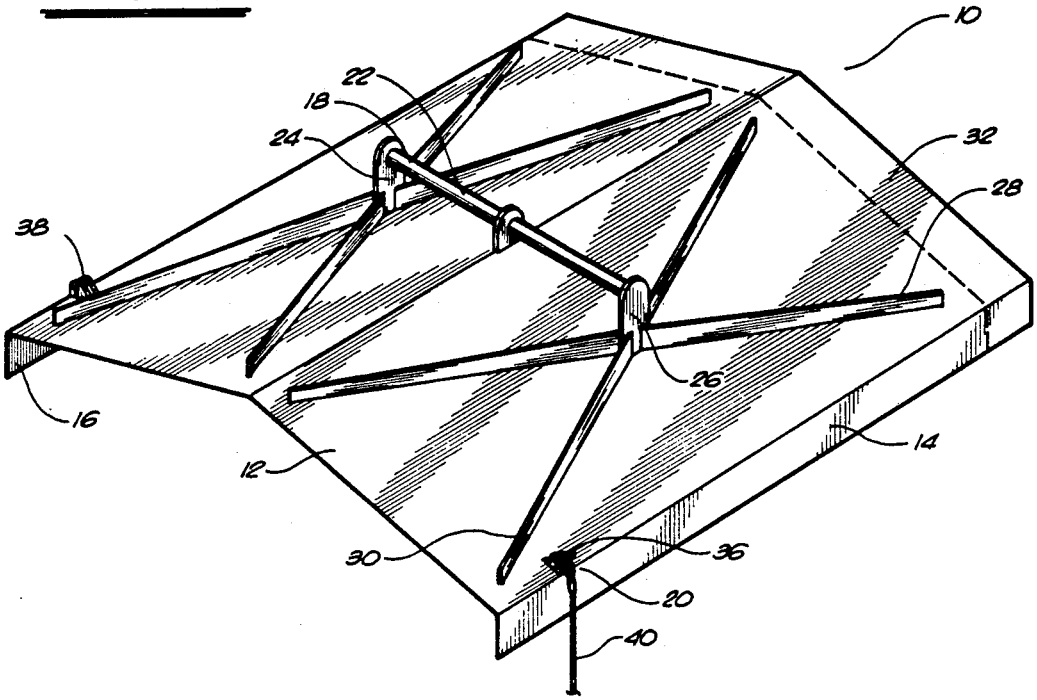
FIG. 1 is a perspective view of the cover in accordance with the preferred embodiment of the present invention.

Referring to FIG. 1, there is shown at 10, the gondola car cover in accordance with the preferred embodiment of the present invention. Gondola car cover 10 comprises the central panel 12, first end portion 14, second end portion 16, handle 18, and locking member 20. The first end portion 14 extends downwardly from one side of the central panel 12. The second end portion 16 also extends downwardly from the other side of the central panel 12. End portions 14 and 16 are designed so as to slidably engage the sides of a gondola car. The distance between the end portions 14 and 16 should be slightly greater than the width of the gondola oar.

The central panel 12 of the gondola car cover 10 has an inverted V-shaped configuration. This inverted V-shaped configuration is designed so as to prevent water from accumulating on the surface of the central panel. Although the inverted V-shaped configuration is illustrated in FIG. 1, as the preferred embodiment, it may be also possible for central panel 12 to have a flat configuration, or a curved upper surface. The central panel 12 is ideally made of a fiberglass material. A fiberglass material will minimize the weight of the cover 10 while maintaining the strength required for the intended usage. Once the cover 10 is installed onto the gondola car, the central panel 12 will cover the interior portion of the gondola car. As such, the present invention acts as a cover for protecting the contents on the interior of the gondola car.

Handle 18 includes a longitudinal member 22 that extends laterally across the central panel 12. This handle 18 is positioned at the balance point of the central panel 12 and should be located at a position suitable for the balancing of the cover 10. Brackets 24 and 26 are utilized so as to maintain longitudinal member 22 in proper position above central panel 12. Each of the brackets 24 and 26 is rigidly affixed to the exterior of the central panel 12. It should be noted that, in an alternative embodiment, handle 18 may be located a few inches away from the balance point. By offsetting the handle from the balance point, two forces will be required to maintain the cover in a horizontal position. This enhances the ability of the system of the present invention to resist swinging of the cover due to wind.

A plurality of stiffener members 28 and 30 extend across the central panel 12. As illustrated in FIG. 1, the stiffener members 28 and 30 extend in a X-shaped pattern on each of the inclines of central panel 12. The stiffener members 28 and 30 serve to maintain the integrity of the cover 10. An extension portion 32 extends outwardly from the central panel 12 at one end. This extension section 32 extends outwardly beyond the stiffener members 28 and 30. The extension section 32 is the portion of the cover 18 that is suitable for overlapping (or underlapping) an adjacent cover.

Lock mechanism 20 includes a first socket 36 and a second socket 38 that are positioned on the central panel 12 adjacent to the first end portion 14 and the second end portion 16, respectively. Sockets 36 and 38 are suitable for attachment to tie-down strap 40. When the cover 10 is installed atop a gondola car, the tie-down strap 40 will serve to affix the cover 10 in position on the gondola car. A suitable connector on the gondola car will receive the other end of the tie-down strap 40. Although a "tie-down strap" is specified herein, many other connectors may serve to connect the cover to the gondola car. The term "tie down strap" should not be construed as a limitation on the present invention.

Figure 2:
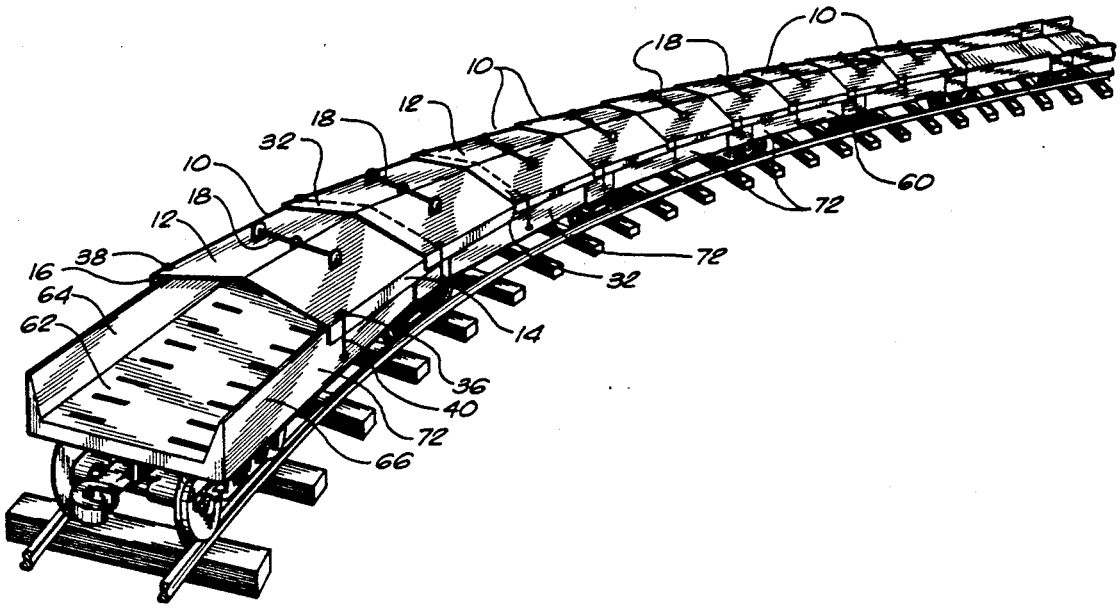
FIG. 2 is a perspective view showing the configuration of the cover in conjunction with a continuous gondola car.

FIG. 2 illustrates the many covers 10 that are utilized on a continuous gondola car 60. Continuous gondola car train 60 has a runway 62 extending continuously therethrough. Gondola car train 60 has parallel side walls 64 and 66. The gondola car train 60, as described herein, is of a type described more completely in U.S. Pat. application Ser. No. 07/302,380, filed on Jan. 27, 1989, by the present inventor. The continuous runway 62 allows a tractor-shovel to pass along the length of the train 60.

As can be seen in FIG. 2, each of the covers 10 is fitted to the parallel side walls 64 of train 60. It can be seen that the top edges of walls 64 will abut the inside surface of the central panel 12 of cover 10. The end portions 14 and 16 will overlie and will be in sliding engagement with the exterior of the side walls 64. Tie-down straps 40 extend from the sockets 36 downwardly. It can be seen that the handle 18 resides at the top of the covers 10.

Figure 3:
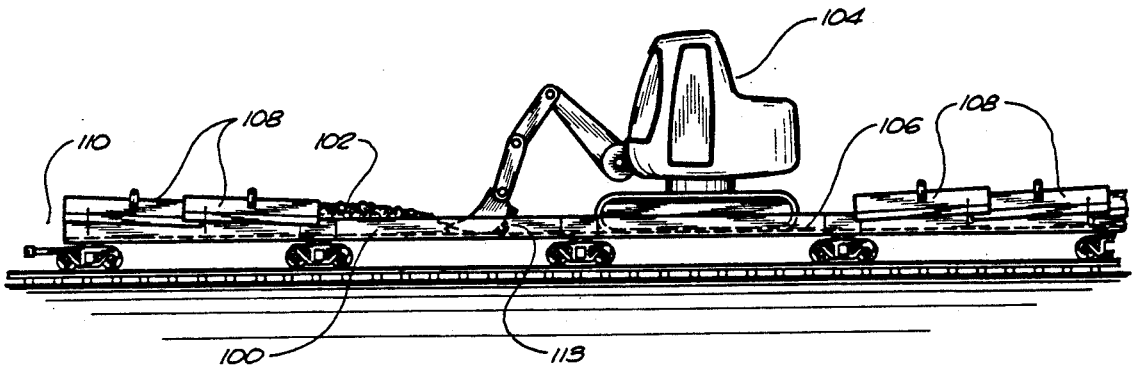
FIG. 3 illustrates the initial steps in the method of the present invention.

It is important to note in FIG. 3, that each of the covers 10 overlaps an adjacent cover 10. Each of the covers 10 has a taper along its length. It has been estimated that the width of the cover will change approximately four inches from one end to the other. The process of manufacturing such covers is facilitated by having each cover of identical configuration to every other cover.

In FIG. 2, it can be seen that the extension section 32 will overlie the end of an adjacent cover 10. This "overlying" relationship should serve to prevent the dispersal of material contained within the train 60. Additionally, this overlapping arrangement will generally prevent rain, and other liquids, from draining into the interior of gondola car train 60. It can be further seen that a plurality of covers 10 will be positioned on each car 72. Although this illustrates the design of the preferred embodiment of the present invention, it may be possible that each car 72 would have a single cover positioned thereon. Alternatively, there could be fewer covers utilized. The number of covers, per gondola car, is not intended as a limitation on the present invention.

FIG. 3 illustrates the method of operating the system of the present invention. Initially, it can be seen that the gondola car train 100 is filled with garbage 102. The tractor shovel 104 rests on the floor 106 of the gondola car train 100. Floor 106 is part of the runway that traverses the entire length of the gondola car train 100. Since the floor 106 is continuous, then the tractor-shovel has freedom of movement across the entire length of the train 100. The restrictions of travel of the tractor-shovel 104 will be governed by the position of each of the covers 108. After the tractor-shovel 104 has removed the garbage 102 so as to place the garbage 102 exterior of train 100, the tractor-shovel 104 will move forward in the direction of end 110

Figure 4:
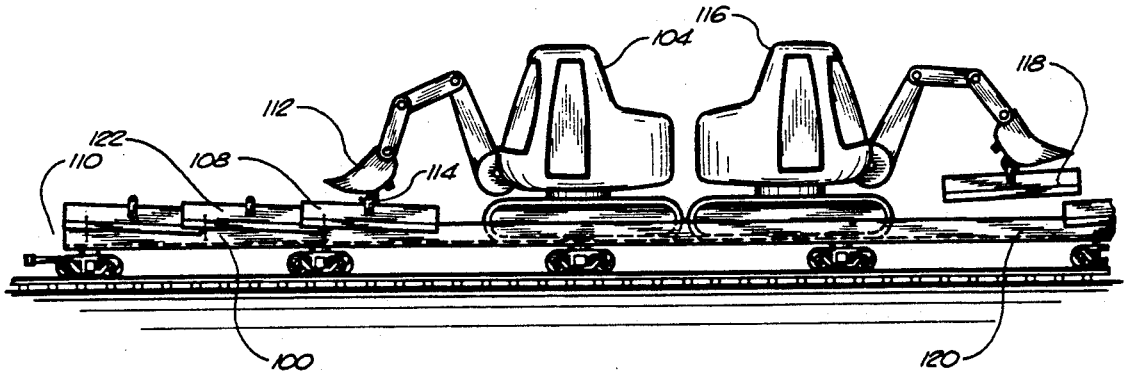
FIG. 4 is an illustration of the continuation of the method of the present invention.

In FIG. 4, it can be seen what happens when the tractor-shovel 104 approaches the cover 108. Initially, the bucket 112 of tractor-shovel 104 will be articulated such that the hooks on the bucket 112 will engage the handle 114 on the top of cover 108. As the shovel lifts the cover 108, the cover will be balanced and controlled by an abutment area 113. The abutment area 113 assists in the lifting of the cover 108 by preventing swinging, swaying or out-of-control motion of cover 113. The tractor-shovel 116 will then rotate (as shown in FIG. 4) so as to transport the cover 118 to its new position. Shovel 116 will then lower the cover 118 into its proper position atop the gondola car 120. As the tractor-shovel 104 continues to traverse the train 100 to end 110, the tractor-shovel 104 will pick up the next cover 122. This cover 122 will then be moved so as to overlap cover 118. Since each of the covers is uniform and tapered, then the same overlapping relationship will be present after the repositioning. As such, there is no need to return the covers to their original position. After each of the covers is removed, and relocated, the tractor-shovel 104 will be free to remove the garbage 102 from within the train 100. The garbage can then be placed in an adjoining truck, or placed on the ground.

The present invention offers a number of improvements over prior systems. First, the present invention offers a secure cover that allows the covering of garbage as it is transported in gondola cars. The use of such a cover prevents the littering of the railway with dispersed garbage. The cover also will keep the garbage from being exposed to the elements, particularly wind and water. Secondly, by using the covers in combination with a continuous gondola car, the covers can be relocated as desired. As the tractor-shovel traverses the continuous runway of the gondola car arrangement, then the covers can be relocated as needed. Additionally, each of the covers is relatively lightweight. Since the covers are relatively lightweight, they can be manipulated easily by the railroad workers. The system of the present invention does not require complicated and expensive unloading facilities Additionally, the present invention eliminates the need for complicated machinery to traverse the upper edge of the gondola cars.

The foregoing disclosure and description of the invention is method steps, as well as in the details of the illustrated apparatus may be made within the scope of the appended claims without departing from the true spirit of the invention. The present invention should be limited to the following claims and their legal equivalents.

I claim:

1. An improved gondola car for transporting commodities, said gondola car being of a type having parallel side walls and a runway extending therebetween, said improvement comprising:

a central panel extending between said side walls so as to cover a portion of said runway, said gondola car being one of a plurality of gondola cars joined together and having a runway extending continuously therethrough, said central panel being one of a plurality of central panels in overlapping relationship extending along the length of said plurality of gondola cars;

a first end portion in sliding engagement with one of said side walls, said first end portion extending downwardly from one side of said central panel;

a second end portion in sliding engagement with the other of said side walls, said second end portion extending downwardly from the other side of said central panel; and a handle connected to the top surface of said central panel so as to allow said central panel to be lifted from said gondola car.

2. The improvement of claim 1, further comprising:

looking means connected to said central panel, said locking means for releasably fixing said central panel to said gondola car.

3. The improvement of claim 1, said central panel having an inverted V-shaped configuration, said central panel comprised of a fiberglass material.

4. The improvement of claim 1, said handle being an elongated member positioned at a balance point of said central panel, said handle extending laterally across said central panel.

5. The improvement of claim 1, further comprising:

a second central panel extending between said side walls so as to cover another portion of said runway, said second central panel overlapping a portion of said first central panel.

6. The improvement of claim 5, said second central panel having end portions that overlap said first and second end portions of said first central panel, said second central panel including a handle mounted on the top surface of said second central panel.

7. The improvement of claim 6, said first central panel and said second central panel of uniform shape, and first and second central panels having a continuously tapered width.

8. The improvement of claim 5, said second central panel having a handle affixed to the middle of said second central panel, said handle enabling said second central panel to be lifted from said gondola car.

9. The improvement of claim 1, said handle being offset from a balance point of said central panel, said handle extending laterally across said central panel.

10. A method of unloading a commodity from a gondola car, said gondola car being of a type having a plurality of covers detachably connected thereto, each of said covers overlapping an adjacent cover, each of said covers having a handle affixed to the top thereof, said method comprising steps of:

moving a tractor-shovel onto a floor of said gondola car;

lifting one of said covers from said gondola car, said step of lifting comprising:

moving a shovel of said tractor-shovel in close proximity to the handle of said cover;

engaging said handle with a hook connected to said shovel; and moving said shovel such that said cover disengages from said gondola car;

transporting said one of said covers such that said cover is positioned on said gondola car aft of said tractor-shovel;

shovelling said commodity from the interior of said gondola car; and dumping said commodity to the exterior of said gondola car.

11. The method of claim 10, said step of engaging said handle comprising:

positioning said shovel of said tractor-shovel such that a portion of said cover abuts a portion of said shovel.

12. The method of claim 10, further comprising steps of:

unlatching said cover from said gondola car prior to the step of lifting; and latching said cover to said gondola car after said cover is transported aft of said shovel.

13. An improved gondola car for transporting commodities, said gondola car being of a type having parallel side walls and a runway extending therebetween, said improvement comprising:

a central panel extending between said side walls so as to cover a portion of said runway;

a first end portion in sliding engagement with one of said side walls, said first end portion extending downwardly from one side of said central panel;

a second end portion in sliding engagement with the other of said side walls, said second end portion extending downwardly from the other side of said central panel; and a handle connected to the top surface of said central panel so as to allow said central panel to be lifted from said gondola car; and a second central panel extending between said side walls so as to cover another portion of said runway, said second central panel overlapping a portion of said first central panel, said second central panel having end portions that overlap said first and second end portions of said first central panel, said second central panel including a handle mounted on the top surface of said second central panel, said first central panel and said second central panel of uniform shape, said first and second central panels having a continuously tapered width.

14. The improvement of claim 13, further comprising:

locking means connected to said central panel, said locking means for releasably fixing said central panel to said gondola car.

15. The improvement of claim 13, said central panel having an inverted V-shaped configuration, said central panel comprised of a fiberglass material.

16. The improvement of claim 13, said handle being an elongated member positioned at a balance point of said central panel, said handle extending laterally across said central panel.

17. The improvement of claim 13, said gondola car being one of a plurality of gondola cars joined together and having a runway extending continuously therethrough, said central panel being one of a plurality of central panels in overlapping relationship extending along the length of said plurality of gondola cars.

18. The improvement of claim 13, said handle being offset from a balance point of said central panel, said handle extending laterally across said central panel.

* * * * *